US010865551B2

(12) United States Patent
Harvin, Jr.

(10) Patent No.: US 10,865,551 B2
(45) Date of Patent: Dec. 15, 2020

(54) RETRACTABLE HOME SHOWER SYSTEM

(71) Applicant: Charles Richard Harvin, Jr., Mt. Pleasant, SC (US)

(72) Inventor: Charles Richard Harvin, Jr., Mt. Pleasant, SC (US)

( * ) Notice: Subject to any disclaimer, the term of this patent is extended or adjusted under 35 U.S.C. 154(b) by 0 days.

(21) Appl. No.: 16/265,157

(22) Filed: Feb. 1, 2019

(65) Prior Publication Data

US 2019/0242100 A1 Aug. 8, 2019

Related U.S. Application Data

(60) Provisional application No. 62/709,828, filed on Feb. 2, 2018.

(51) Int. Cl.

| | |
|---|---|
| ***F16L 3/12*** | (2006.01) |
| ***E03C 1/02*** | (2006.01) |
| ***E03C 1/04*** | (2006.01) |
| ***E03C 1/06*** | (2006.01) |

(52) U.S. Cl.

CPC ..... *E03C 1/0408* (2013.01); *E03C 1/025* (2013.01); *E03C 1/066* (2013.01)

(58) Field of Classification Search

CPC ..... E03C 1/0408; E03C 1/025; E03C 1/06; E03C 1/066; F16L 3/1226

USPC ..... 4/596, 599, 600; 138/106, 107, 108

See application file for complete search history.

(56) References Cited

U.S. PATENT DOCUMENTS

| | | | | |
|---|---|---|---|---|
| 4,532,949 | A * | 8/1985 | Frank | B26F 3/008 137/1 |
| 4,561,136 | A * | 12/1985 | Baer | E03C 1/066 4/615 |
| 6,349,428 | B1 | 2/2002 | Nasr et al. | |
| 6,381,770 | B1 | 5/2002 | Raisch | |
| 7,191,475 | B1 | 3/2007 | Marcotte | |
| 2004/0010848 | A1 | 1/2004 | Esche | |
| 2004/0216789 | A1 * | 11/2004 | Benstead | E03C 1/04 137/801 |
| 2005/0241714 | A1 * | 11/2005 | Barnhouse | F16L 3/26 138/106 |
| 2009/0044329 | A1 | 2/2009 | Kestian et al. | |
| 2016/0237661 | A1 | 8/2016 | Teagarden | |

* cited by examiner

*Primary Examiner* — Paul J Gray

(74) *Attorney, Agent, or Firm* — Gregory Finch; Finch Paolino, LLC

(57) ABSTRACT

A retractable home shower system enables a retractable shower assembly in which the shower head may be selectively extended from a shower wall by a user for use during bathing, and may be selectively retracted back into the shower wall upon completion of use by the user. Retractable home shower system may be generally comprised of a routing pipe, an escutcheon plate shower arm, a shower head, a flexible shower hose, and a counter weight. Routing pipe, flexible shower hose and counter weight may be concealed in the interior space behind a shower wall in a shower.

13 Claims, 5 Drawing Sheets

RETRACTABLE HOME SHOWER SYSTEM

CROSS REFERENCE TO RELATED APPLICATIONS

The present application claims the benefit of U.S. Provisional Application 62/709,828, filed on Feb. 2, 2018 and entitled "SNAKELESS SHOWER," the disclosure of which is hereby incorporated in its entirety at least by reference.

FIELD

The present disclosure relates to the field of plumbing fixtures; in particular, a retractable home shower kit and system.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

An object of the present disclosure is a retractable shower kit comprising a shower arm having a first threaded portion and a second threaded portion, and being bent along a length of the shower arm; an escutcheon plate being convex in shape from a face side to a rear side, and having a circular aperture disposed at a center of the escutcheon plate, the circular aperture being configured to receive the shower arm therethrough; a flexible hose pipe extending from a first end to a second end, the first end comprising a first coupling being configured to be coupled to the first threaded portion of the shower arm, the second end comprising a second coupling being configured to be coupled to a fitting of a water valve; and, a routing pipe extending from a first open end to a second open end, the routing pipe comprising a first elbow portion extending from the first open end and having a 90 degree bend around a first vertical axis, a second elbow portion extending from the second open end and having a 90 degree bend around a first longitudinal axis, and a body portion being coupled between the first elbow portion and the second elbow portion along a first transverse plane.

Another object of the present disclosure is a retractable shower system comprising an escutcheon plate being convex in shape from a face side to a rear side, and having a circular aperture disposed at a center of the escutcheon plate; a shower arm extending through the circular aperture of the escutcheon plate and having a first threaded portion and a second threaded portion, the shower arm being bent along a length of the shower arm; a flexible hose pipe extending from a first end to a second end, the first end comprising a first coupling being removably coupled to the first threaded portion of the shower arm, the second end comprising a second coupling being removably coupled to a fitting of a water valve; and, a routing pipe configured to be coupled to an interior portion of a shower wall adjacent to the escutcheon plate, the routing pipe extending from a first open end to a second open end, the routing pipe comprising a first elbow portion extending from the first open end and having a 90 degree bend around a first vertical axis, a second elbow portion extending from the second open end and having a 90 degree bend around a first longitudinal axis, and a body portion being coupled between the first elbow portion and the second elbow portion along a first transverse plane, the flexible hose pipe being slidably interfaced with an interior portion of the routing pipe between the first open end and the second open end.

Yet another object of the present disclosure is a shower plumbing apparatus comprising a routing pipe configured to be coupled to an interior portion of a shower wall, the routing pipe extending from a first open end to a second open end, the routing pipe comprising a first elbow portion extending from the first open end and having a 90 degree bend around a first vertical axis, a second elbow portion extending from the second open end and having a 90 degree bend around a first longitudinal axis, and a body portion being coupled between the first elbow portion and the second elbow portion along a first transverse plane, the routing pipe being configured to receive a flexible hose pipe being slidably interfaced with an interior portion of the routing pipe between the first open end and the second open end.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The above and other objects, features and advantages of the present disclosure will be more apparent from the following detailed description taken in conjunction with the accompanying drawings, in which.

DETAILED DESCRIPTION

Figure 1:
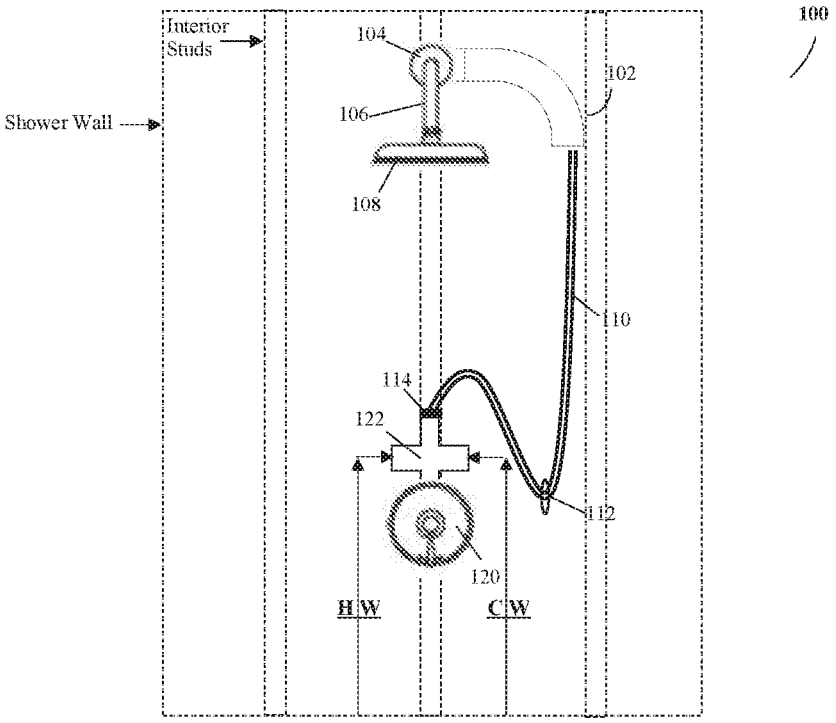
FIG. 1 is a front plan view of a retractable home shower system, according to an embodiment of the present disclosure.

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Furthermore, when it is said herein that something is "based on" something else, it may be based on one or more other things as well. In other words, unless expressly indicated otherwise, as used herein "based on" means "based at least in part on" or "based at least partially on." Like numbers refer to like elements throughout.

The terminology used herein is for describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including,", and variants thereof, when used herein, specify the presence of stated features, steps, operations, elements, and/or components, but do not preclude the presence or addition of one or more other features, steps, operations, elements, components, and/or groups thereof.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein, the term "and/or" includes any and all combinations of one or more of the associated listed items.

Spatially relative terms, such as "above," "below," "upper," "lower," "top, "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments. Unless otherwise defined, all terms (including technical and scientific terms) used herein have the same meaning as commonly understood by one of ordinary skill in the art to which these embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Referring now to FIG. 1, a front plan view of a retractable home shower system 100 is shown. According to an embodiment of the present disclosure, retractable home shower system 100 enables a retractable shower head in which the shower head may be selectively extended from a shower wall by a user for use during a shower and be selectively retracted back into the shower wall upon completion of use by the user. Retractable home shower system 100 may be generally comprised of a routing pipe 102, an escutcheon plate 104, a shower arm 106, a shower head 108, a flexible shower hose 110, and a counter weight 112. Routing pipe 102, flexible shower hose 110 and counter weight 112 may be concealed in the interior space behind a shower wall in a shower. According to an embodiment, routing pipe 102 is coupled to a first interior stud of the shower wall at a first end of routing pipe 102 and is coupled to a second interior stud of the shower wall at a second end of routing pipe 102. Flexible shower hose 110 may be coupled to a water valve 122 at a first end via a valve coupling 114. Valve coupling 114 may be threaded and/or may include a valve stem configured to interface with a connector portion of water valve 122. Counter weight 112 may be configured as a weighted ring, and flexible shower hose 110 may be threaded through a circular aperture of counter weight 112, such that counter weight 112 may freely slide along a length of flexible shower hose 110. Escutcheon plate 104 may be coupled to an exterior surface of the shower wall adjacent to the first end of routing pipe 102. Shower arm 106 may be coupled to shower head 108 at a first end. Shower arm 106 may extend through an aperture of escutcheon plate 104 at a second end and may partially extend into a first opening of routing pipe 102. Flexible shower hose 110 may extend from a first end, being coupled to water valve 122 via valve coupling 114, through the second end of routing pipe 102, through an interior portion of routing pipe 102, and exit via the first opening of routing pipe 102 at the first end. Shower arm 106 may be coupled at a second end to flexible shower hose 110 via shower arm coupling 118 (shown in FIG. 2B). Routing pipe 102 is configured to route flexible shower hose 110 such that shower arm coupling 118 of flexible shower hose 110 is aligned with shower arm 106 at a first end of routing pipe 102, and laterally redirect flexible shower hose 110 laterally and downward toward to the second end of routing pipe 102 such that flexible shower hose 110 is substantially aligned with the interior stud coupled to the second end of routing pipe 102. The shape and interior path of routing pipe 102, as discussed in more detail below, is configured to prevent entanglement of flexible shower hose 110 with cold water (CW) and hot water (HW) supply lines, as well as promote a gravity fall of flexible shower hose 110 to promote retraction of flexible shower hose 110 into the wall in a retracted position.

Figure 2A:
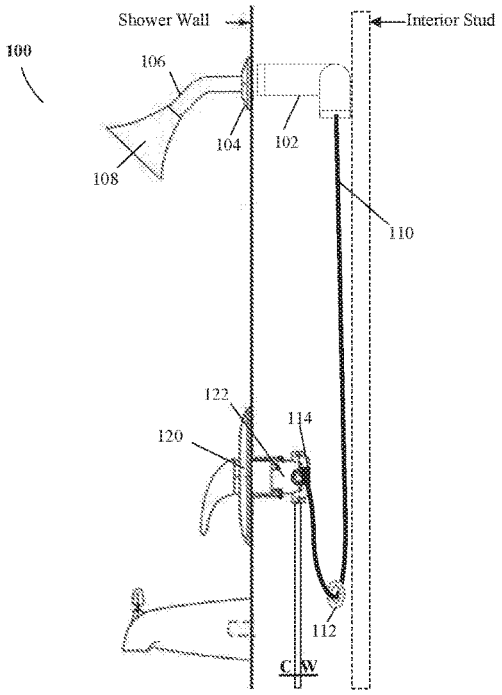
FIG. 2A is a side view of a retractable home shower system with the shower head in a retracted position, according to an embodiment of the present disclosure.
Figure 2B:
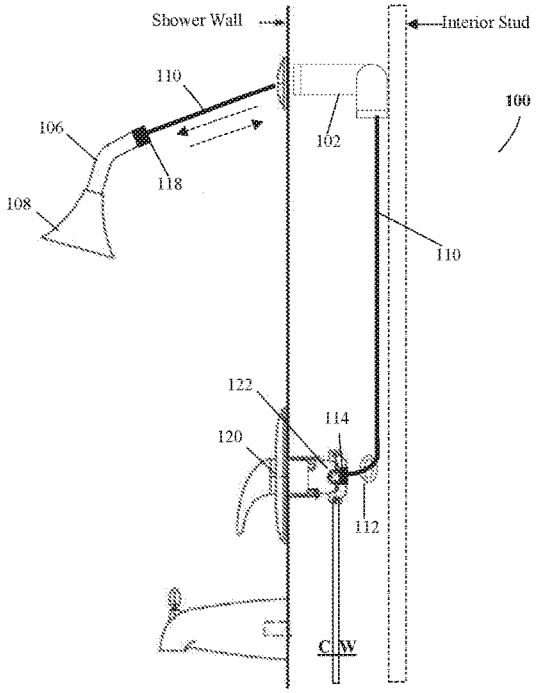
FIG. 2B is a front plan view of a retractable home shower system with the shower head in an extended position, according to an embodiment of the present disclosure.

Referring now to FIGS. 2A and 2B, side views illustrating a functional embodiment of retractable home shower system 100 are shown. According to an embodiment of the present disclosure, retractable home shower system 100 may be configured between a retracted position, as shown in FIG. 2A, and an extended position, as shown in FIG. 2B. A user may extend shower arm 106 from the finished wall by decoupling shower arm 106 from escutcheon plate 104. A length of flexible shower hose 110 may extend from an interior portion of the shower wall to an exterior portion of the shower wall via the aperture in escutcheon plate 104. The user may utilize the length of flexible shower hose 110 in order to direct shower head 108 into a desired position while bathing. The user may retract flexible shower hose 110 back into the interior portion of the shower wall by feeding flexible shower hose 110 back through the aperture in escutcheon plate 104. Shower arm 106 may be friction fit with escutcheon plate 104 via the aperture in escutcheon plate 104. Alternatively, escutcheon plate 104 may have a coupling means, such as a mechanical mating element or magnetic coupling element, to selectively secure shower arm 106 to escutcheon plate 104 when not in use.

Figure 3:
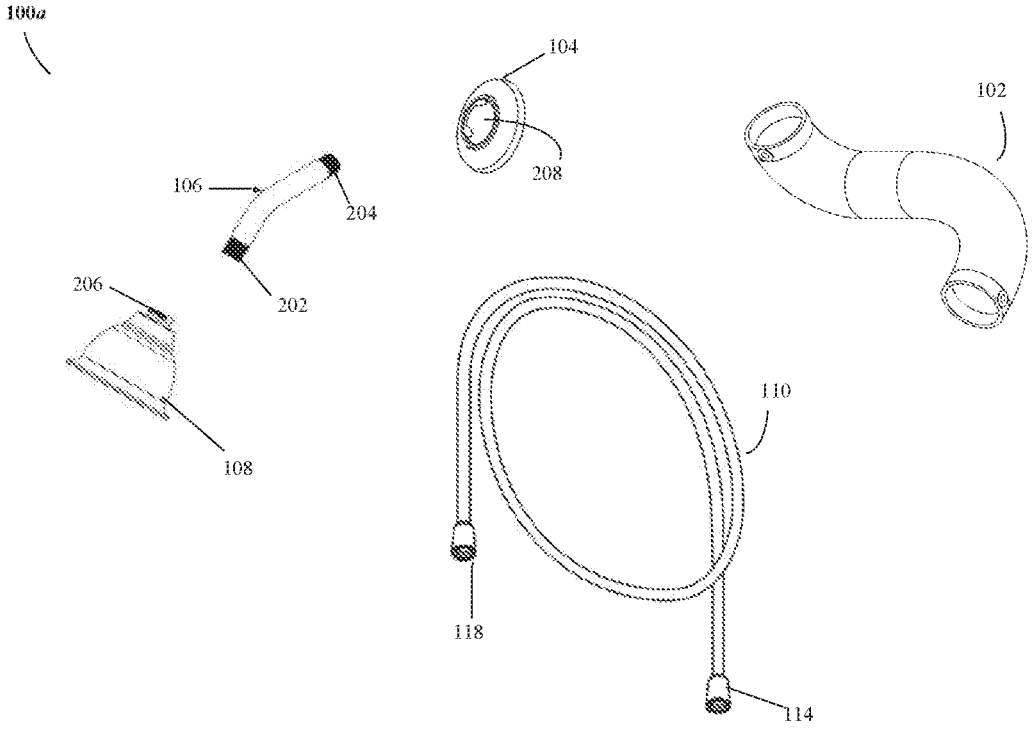
FIG. 3 is a component view of a retractable home shower kit, according to an embodiment of the present disclosure.

Referring now to FIG. 3, a component view of a retractable home shower kit 100*a* is shown. According to an embodiment of the present disclosure, retractable home shower kit 100*a* is a component view of retractable home shower system 100 (as shown above in FIGS. 1 and 2A-2B). Retractable home shower kit 100 is comprised of shower head 208, shower arm 106, escutcheon plate 104, routing pipe 102, and flexible shower hose 110. Shower head 108 may have a threaded connector portion 206 configured to be coupled to a first threaded portion 204 of shower arm 106. Shower arm 106 may have a first threaded portion 202 configured to be coupled to shower head 108, and a second threaded portion 204 configured to be coupled to flexible shower hose 110. Shower arm 106 may be bent along a length of shower arm 106 to direct shower head 108 in a downward direction. Escutcheon plate 104 may be convex in shape from a first surface to a second surface, and may comprise a circular aperture 208 disposed in the center of escutcheon plate 104. Circular aperture 208 may be configured to be friction fit with shower arm 106. Flexible shower hose 110 may comprise a shower arm coupling 118 at one end and a valve coupling 114 at another end. Flexible shower hose 110 may be configured in various lengths, for example between 6 feet and 12 feet in length. Flexible shower hose 110 may comprise a rubber inner hose disposed inside a flexible stainless-steel outer hose. The rubber inner hose may be constructed of an EPDM material and may have a ⅜" outer diameter and a ¼" inner diameter. The flexible stainless-steel outer hose may have a ½" outer diameter and a 7⁄16" inner diameter. Routing pipe 102 may be constructed of PVC or other commercially feasible material commonly used in commercial and residential plumbing applications. The shape and dimensions of routing pipe 102 are discussed in more detail in FIG. 4, below.

Figure 4:
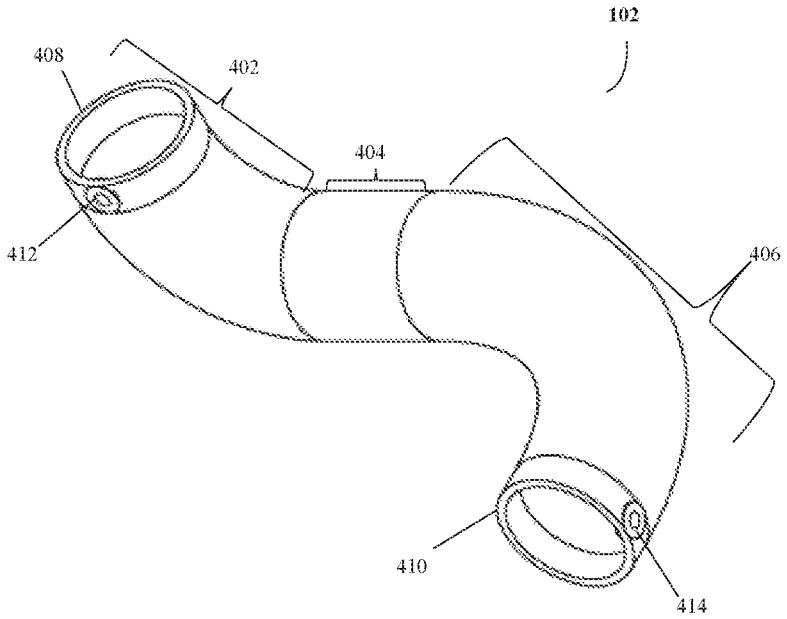
FIG. 4 is a perspective view of a hose redirection pipe of a retractable home shower system, according to an embodiment of the present disclosure.

Referring now to FIG. 4, a perspective view of routing pipe 102 is shown. According to an embodiment of the present disclosure, routing pipe 102 is configured to extend from a first open end 408 to a second open end 410. Routing pipe 102 comprises a first elbow portion 402 extending from the first open end 408. First elbow portion 402 is configured to have a 90-degree bend around a first vertical axis (when installed in retractable home shower system 100, as shown above). Routing pipe 102 comprises a second elbow portion 406 extending from the second open end 410. Second elbow portion 406 is configured to have a 90-degree bend around a first longitudinal axis (when installed in retractable home shower system 100, as shown above). First elbow portion 402 and second elbow portion 406 are configured to extend from a body portion 404 along a first transverse plane (when installed in retractable home shower system 100, as shown above). Routing pipe 102 may further comprise a first screw aperture 412 being disposed on a surface of first elbow portion 402 adjacent to the first opening 408; and, a second screw aperture 414 being disposed on a surface of the second elbow portion 406 adjacent to the second opening 410.

Figure 5A:
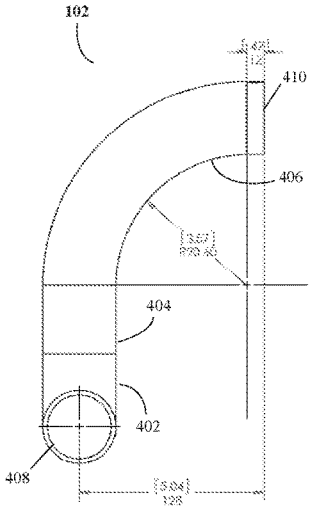
FIG. 5A is a plan view of a hose redirection pipe of a retractable home shower system, according to an embodiment of the present disclosure.
Figure 5B:
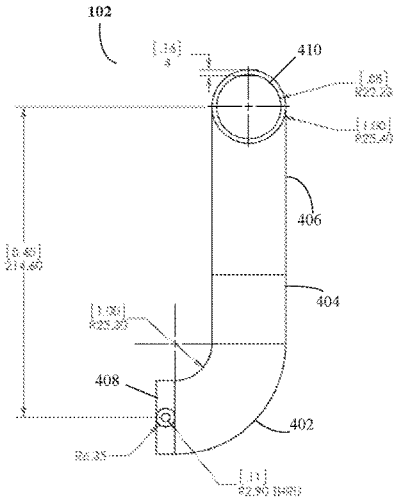
FIG. 5*b* is a plan view of a hose redirection pipe of a retractable home shower system, according to an embodiment of the present disclosure; and, FIG. 5C is a plan view of a hose redirection pipe of a retractable home shower system, according to an embodiment of the present disclosure.
Figure 5C:
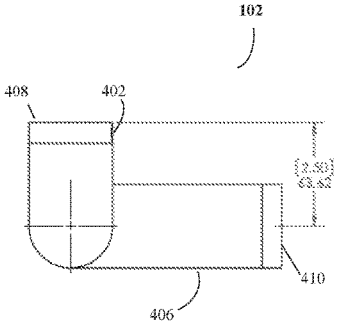

Referring now to FIGS. 5A-5C, various plan views of routing pipe 102 are shown. According to an embodiment of the present disclosure, second elbow portion 406 may be approximately 5 inches in height from when measured from a terminal surface of second open end 410 to a center point of first open end 408. An inner arc of second elbow portion 406 may have a zenith of approximately 4 inches. First elbow portion 402 may be approximately 2.5 inches in height from when measured from a terminal surface of first open end 408 to a center point of second open end 410. An inner arc of second elbow portion 402 may have a zenith of approximately 1 inch. Numerous alternative configurations are anticipated; however, routing pipe 102 should generally not exceed 16 inches such that routing pipe 102 may fit between standard framing widths inside the shower wall.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention. Therefore, it will be apparent to those skilled in the art that various modifications and variations can be made to the disclosed embodiments without departing from the scope or spirit of the invention. In view of the foregoing, it is intended that the invention covers modifications and variations of this disclosure within the scope of the following claims and their equivalents.

What is claimed is:

1. A retractable shower kit comprising:

a shower arm having a first threaded portion and a second threaded portion, and being bent along a length of the shower arm;

an escutcheon plate being convex in shape from a face side thereof to a rear side thereof, and having a circular aperture disposed at a center portion of the escutcheon plate, the circular aperture being configured to receive the shower arm therethrough;

a flexible hose pipe extending from a first end of the flexible hose pipe to a second end of the flexible hose pipe, the first end comprising a first coupling being configured to be coupled to the first threaded portion of the shower arm, and the second end comprising a second coupling configured to be coupled to a fitting of a water valve; and, a routing pipe comprising:

a body portion extending from a first open end of the routing pipe to a second open end of the routing pipe, a first elbow portion and a second elbow portion, the first elbow portion extending from the first open end of the routing pipe and having a 90 degree bend around a vertical axis thereof, the second elbow portion extending from the second open end of the routing pipe and having a 90 degree bend around a longitudinal axis thereof, and the body portion extending from the first open end of the routing pipe to the second open end of the routing pipe being coupled between the first elbow portion and the second elbow portion along a transverse plane, a first screw aperture disposed on a first portion of the routing pipe adjacent to the first open end of the routing pipe, and a second screw aperture disposed on a second portion of the routing pipe adjacent to the second open end of the routing pipe.

2. The retractable shower kit of claim 1 wherein the flexible hose pipe comprises a flexible rubber inner hose and a flexible stainless-steel outer hose.

3. The retractable shower kit of claim 1 further comprising a counter weight, wherein the counter weight is configured to be slidably coupled to the flexible hose pipe.

4. The retractable shower kit of claim 1 further comprising a shower head, wherein the shower head is configured to be coupled to the shower arm.

5. The retractable shower kit of claim 1 wherein the shower arm further comprises a shower head.

6. The retractable shower kit of claim 1 wherein the routing pipe has a length in a range of from 8 inches to 12 inches.

7. A retractable shower system comprising:

an escutcheon plate that is convex in shape from a face side to a rear side thereof, and comprises a circular aperture disposed at a center portion thereof;

a shower arm extending through the circular aperture of the escutcheon plate, the shower arm comprising a first threaded portion and a second threaded portion, and being bent along a length thereof, a routing pipe configured to be coupled to an interior portion of a shower wall adjacent to the escutcheon plate, the routing pipe extending from a first open end of the routing pipe to a second open end of the routing pipe, and comprising:

a first elbow portion extending from the first open end of the routing pipe and having a 90 degree bend around a vertical axis thereof, a first screw aperture disposed on a first portion of the first elbow portion adjacent to the first open end of the routing pipe, a second elbow portion extending from the second open end of the routing pipe and having a 90 degree bend around a longitudinal axis thereof, a second screw aperture disposed on a second portion of the second elbow portion adjacent to the second open end of the routing pipe, and a body portion coupled between the first elbow portion and the second elbow portion along a transverse plane: and a flexible hose pipe extending from a first end of the flexible hose pipe to a second end of the flexible hose pipe, the first end of the flexible hose pipe comprising a first coupling that is removably coupled to the first threaded portion of the shower arm, and the second end of the flexible hose pipe comprising a second coupling that is removably coupled to a fitting of a water valve, wherein the flexible hose pipe is slidably interfaced with an interior portion of the routing pipe between the first open end of the routing pipe and the second open end of the routing pipe.

8. The retractable shower system of claim 7 wherein the flexible hose pipe comprises a flexible rubber inner hose and a flexible stainless-steel outer hose.

9. The retractable shower system of claim 7 further comprising a counter weight slidably coupled to the flexible hose pipe.

10. The retractable shower system of claim 7 further comprising a shower head removably coupled to the second threaded portion of the shower arm.

11. The retractable shower system of claim 7 wherein the first threaded portion of the shower arm is configured to be coupled to a shower head and the second threaded portion of the shower arm is configured to be coupled to the flexible hose pipe.

12. The retractable shower system of claim 7 wherein the shower system is configured to have a retracted position and an extended position, wherein the retracted position comprises a length of the shower arm retracted in the interior portion of the shower wall via the circular aperture in the escutcheon plate and the extended position comprises a length of the flexible hose pipe extending from the interior portion of the shower wall to an exterior portion of the shower wall via the circular aperture in the escutcheon plate.

13. The retractable shower system of claim 12 wherein the circular aperture of the escutcheon plate is configured to be friction fitted with the shower arm extending therethrough.

* * * * *